United States Patent [19]

Seglin et al.

[11] 4,452,491

[45] Jun. 5, 1984

[54] RECOVERY OF HYDROCARBONS FROM DEEP UNDERGROUND DEPOSITS OF TAR SANDS

[75] Inventors: Leonard Seglin, New York, N.Y.; Erik Saller, Stanford, Conn.

[73] Assignee: Intercontinental Econergy Associates, Inc., New York, N.Y.

[21] Appl. No.: 305,557

[22] Filed: Sep. 25, 1981

[51] Int. Cl.[3] ..... E21B 43/24

[52] U.S. Cl. ..... 299/5; 299/11

[58] Field of Search ..... 299/2, 4, 5, 7, 11

[56] References Cited

U.S. PATENT DOCUMENTS

| | | | |
|---|---|---|---|
| 3,050,289 | 8/1962 | Gerner | 299/5 |
| 3,459,003 | 8/1969 | O'Neal | 299/11 |
| 3,472,553 | 10/1969 | Miller | 299/5 |
| 3,510,168 | 5/1970 | Camp | 299/7 |
| 4,101,172 | 7/1978 | Rabbitts | 299/2 |
| 4,109,715 | 8/1978 | Adamson | 299/5 |
| 4,212,353 | 7/1980 | Hall | 299/7 |
| 4,234,232 | 11/1980 | Smith et al. | 299/7 |

*Primary Examiner*—William F. Pate, III
*Attorney, Agent, or Firm*—Milton Zucker

[57] ABSTRACT

A method is provided for mining deep tar sand deposits which minimizes energy losses and surface subsidance due to cavity collapse. A well is sunk through the overburden and tar sands deposit into the bedrock below the deposit; the well is sealed and pressurized with steam and inert gas. Hot aqueous fluid is directed against the deposit to melt the tar and form a tar-sand-water slurry which is passed to a surface recovery plant. Pressure is maintained in the well sufficiently high to hold the overburden. Energy losses are minimized by maintaining the pressure both in the well and the surface plant above the boiling point of the water at the temperature used, which may be as high as 450° F. or more, subsidence is prevented by keeping at least a 10 foot thick ceiling of tar sands throughout the operation, and by backfilling the well with an aqueous slurry of sand after mining operations are complete, before releasing pressure on the well.

5 Claims, 3 Drawing Figures

RECOVERY OF HYDROCARBONS FROM DEEP UNDERGROUND DEPOSITS OF TAR SANDS

FIELD OF THE INVENTION

This invention is concerned with the recovery of hydrocarbons from deposits of unconsolidated tar sands deep under the surface of the earth and aims to provide a process which is economical to operate, and which permits the recovery of the hydrocarbon values in such deposits, while eliminating the danger of excessive surface sunsidence.

BACKGROUND OF THE INVENTION

North America has vast deposits of tar sands, which are mixtures of viscous hydrocarbons and sand. Some of these deposits are consolidated (sand stone) while others are unconsolidated and disintegrate upon heating. A minor percentage of the deposits are at or close to the surface, and are mined by removing any overburden, and then physically removing the tar sands to plants in which the viscous hydrocarbons are separated from the sand. The adhesive nature of the tar sands, and their abrasiveness, tend to make the operations difficult and expensive, particularly in the upkeep of equipment. In spite of the difficulties, commercial operations are currently being conducted in Canada.

However, over 80% of the tar sands deposits are situated well under the surface of the earth, far enough below so that removal of the overburden is not practical. In many locations, there are beds of tar sands 100 feet and more in thickness, situated 300 feet or more below the surface. There has been no commercial exploitation of this huge reserve of hydrocarbons, which are larger than the known oil reserves of the Persian Gulf.

Workers in the field have approached the problem in various ways. The most logical prior art suggestions known by us are made in the Walker U.S. Pat. No. 3,858,654—Jan. 7, 1975, and the Redford U.S. Pat. No. 3,951,457—Apr. 20, 1976. In those patents, a well is sunk through the overburden into near the bottom of the tar sands deposit, and the well is cemented to the overburden. Hot aqueus alkaline fluid is directed against the tar sands to heat it to the point where the hydrocarbons become sufficiently liquid so that they can be forced up the well to a recovery system where the hydrocarbons are separated from the hot aqueous fluid. During mining, the cavity is maintained at a pressure high enough to support the overbruden, using a non-condensable gas to maintain the pressure. The injected aqueous fluid is maintained at about 180° to 200° F. to obtain a tar sands temperature of 160° F., preferably near 180° F.

The methods suggested by these patents have not been commercialized for a number of reasons. The recovery of the hydrocarbon values will be difficult to accomplish in a single decanter, as suggested in the patents, because the specific gravity of the heavy hydrocarbons is very near that of water. In addition, the patents disclose no effective provision for preventing roof collapse either during mining or after completion of the operation.

It is the principal object of this invention to provide a method of hydraulic mining of unconsolidated tar sands at depths unsuitable for strip mining, which is both energy efficient, and which provides means for preventing collapse of the cavity during, and after completion of, the mining.

STATEMENT OF THE INVENTION

In accordance with the instant invention, we have found that the mining of thick tar sands deposits too deeply situated to permit strip mining can be economically carried out while avoiding surface subsidence and excessive heat losses by using the known techniques of (1) sinking a shaft through the overburden to the bottom of the tar sands deposit, and cementing a casing through the overburden; (2) injecting into the cavity a mixture of steam and inert non-condensing gas to maintain the pressure required to prevent collapse of the cavity roof and to maintain the temperature required to heat the tar above its flow point; (3) directing a high velocity stream of hot aqueous fluid against the tar sand deposit to shear a slurry of aqueous fluid, tar and sand which will flow toward the outlet, bringing said hot slurry to the surface; (4) there separating the hydrocarbons from the sand and hot aqueous fluid, and returning the hot aqueous fluid to the well, and modifying said techniques by:

(a) Maintaining at least a ten foot thick ceiling of tar sands in the cavity throughout the mining operation in order to provide a gas-impermeable seal and hence preventing the roof from falling in.

(b) Maintaining both the subsurface operations, and surface operations for separating oil from sand and water, at sufficiently high pressure so that the water is below its boiling point and the system does not cool off and lose heat by evaporation of water, and, (c) Backfilling the cavity after primary hydraulic mining is completed and before depressurization with spent sand and aqueous fluid to ensure against collapse of the cavity after depressurization and to dispose of the sand in an ecologically acceptable manner.

The collapse of the cavity, with resultant surface subsidence, is prevented by the combination of the technique of maintaining gas pressure against an impermeable seal during operation, and backfilling with sand and water after mining is complete, and before depressurization. The backfill preferably is the sand taken out of a cavity; in a continuing operation, it will be sand taken out of a subsequent cavity.

By maintaining pressures throughout the system so that the boiling point of the water therein is always above its actual temperature in the system, heat requirements are minimized, since the high energy requirements for converting water into steam are avoided. Additionally, by maintaining the surface plant under pressure the energy for pumping is minimized; the energy for pumping will only be that necessary to overcome the friction losses of the system. Our invention makes it possible to achieve a thermal efficiency of about 90%. In other words, each barrel of oil recovered will require one tenth of a barrel of oil for heat and power. This compares with more than one-half barrel of oil required for each barrel of oil recovered using conventional steam flooding for heavy oil recovery.

DETAILED DESCRIPTION OF THE INVENTION

Figure 1:
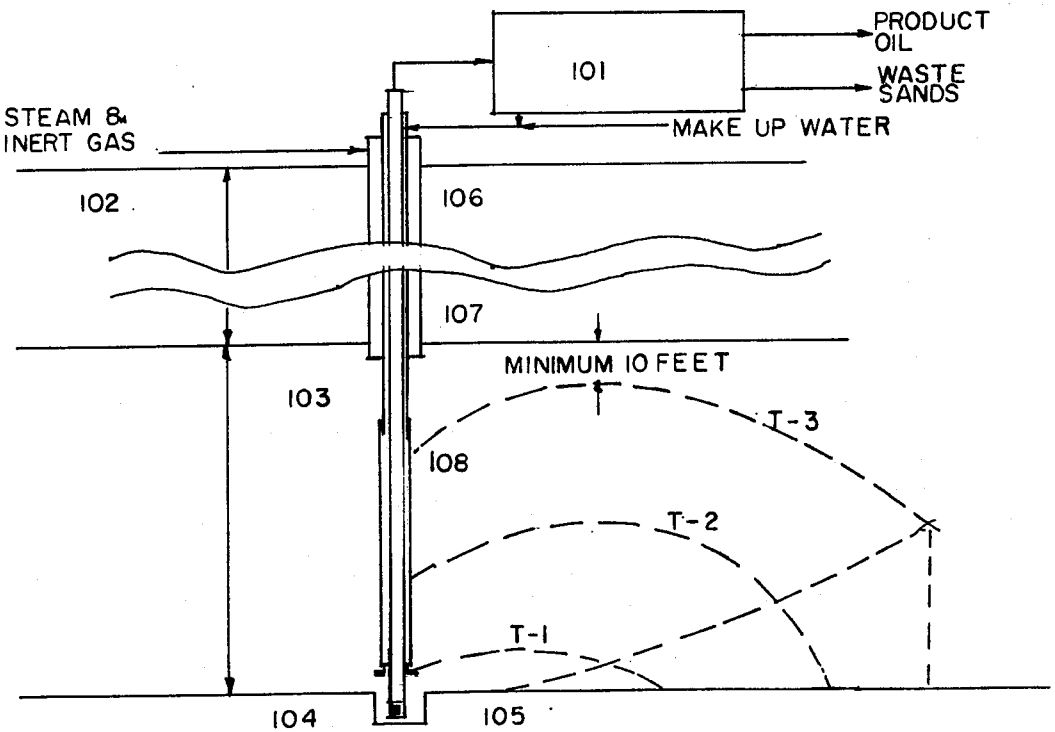

FIG. 1 is a block flow diagram of the complete system used in the process of this invention and also shows the cavity profile versus time during mining.

Figure 2:
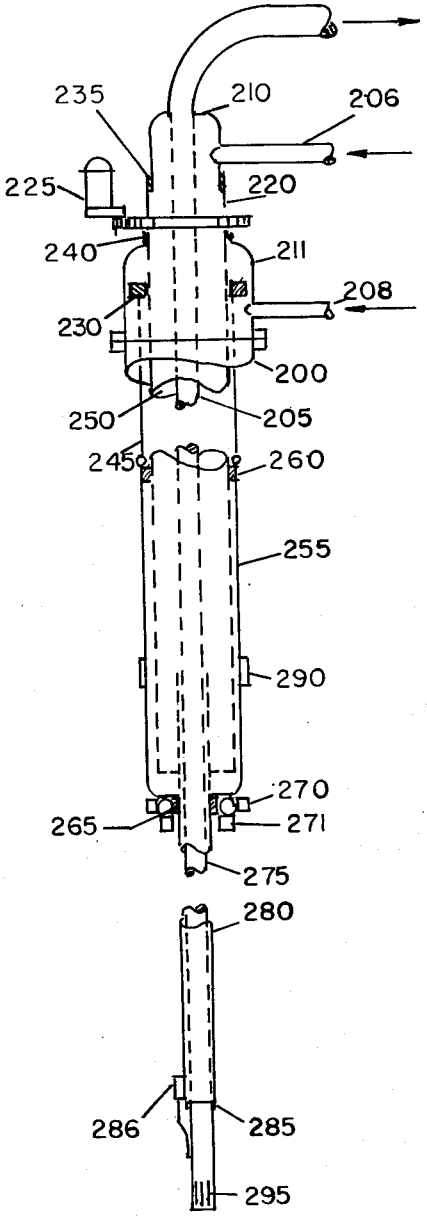

FIG. 2 details the well tool.

Figure 3:
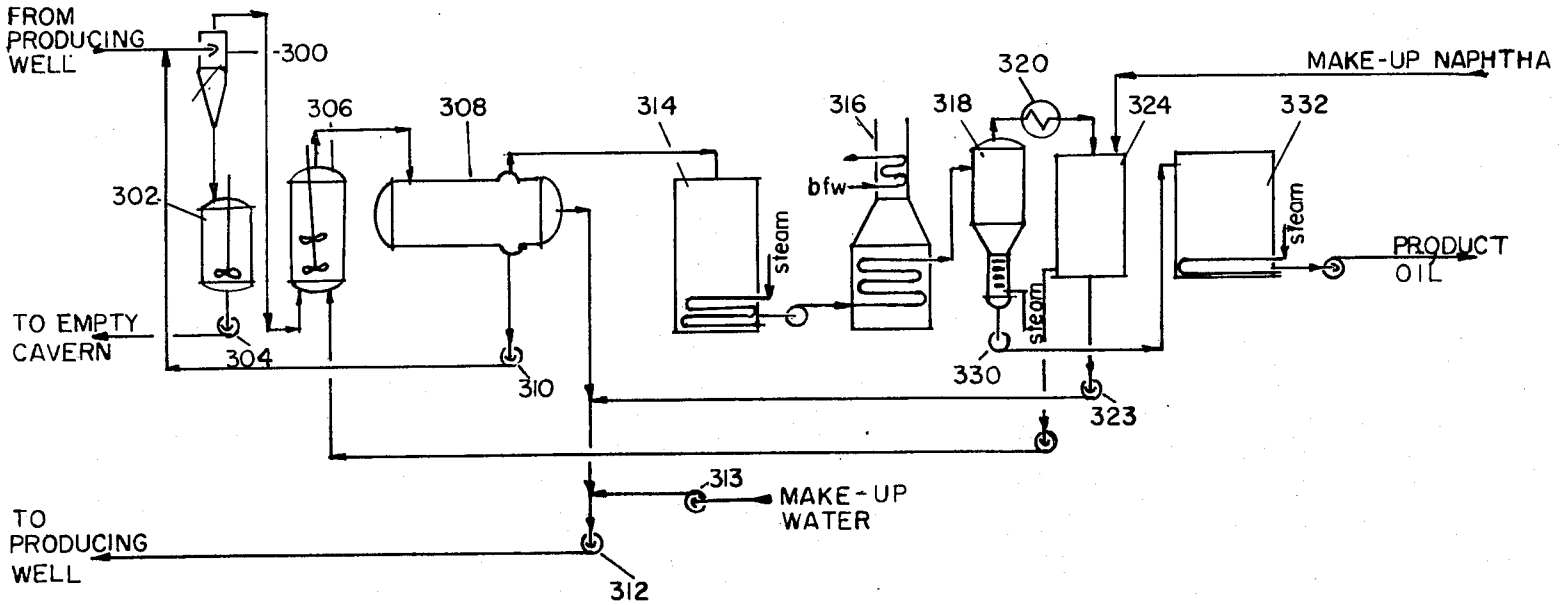

FIG. 3 is a flow diagram of the surface plant.

Referring now to FIG. 1, a thick layer of tar sands (103) lies between an upper layer of overburden (102) and bedrock (104). The tar sands layer (103) is typically 100 feet or more in thickness; the overburden (102) is 500 feet or more. A well (106) is sunk through the overburden (102) and the tar sands layer (103) into the bedrock (104) to form a collection sump (105). The well is cased and cemented (107) through the overburden (102) into the tar sands layer (103). The casing (107) is typically 5 feet in diameter. The tar sands are dislodged from the cavity by the well tool (108) and are removed from the cavity as a slurry of hydrocarbons, sand and aqueous solution through the central pipe (109) of the well tool (108) to the surface plant (101). The mining operation and the progressive change of the cavity with time is described below.

Referring to FIG. 2, the well tool (108) consists of two concentric pipes which enter through the well head and casing (107). The center pipe (109), which is stationary, extends into the sump (105, FIG. 1) at the bottom of the well and serves as the conduit for the removal of the oil, water, sand slurry. The outer pipe (106) which extends about halfway into the tar deposit (103, FIG. 1) can be oscillated 90° about the vertical axis by a motor drive (225), is sealed with rotary seals (235) and (240) to the inlet head (210) and the well head (211), the lower end of which is flanged to the well casing (107). The outlet pipe (109) is welded to the inlet head (210). Recycle mining water and make-up water from the surface plant (101, FIG. 1) is introduced through pipe (206) and passes through the annulus (250) formed between the outlet pipe (109) and the inlet pipe (106). High pressure steam and inert gas for pressurization of the cavity is introduced through pipe (208) in the well head (211). A sleeve (255) with four high velocity-high volume nozzles (270) located at the bottom is placed around the lower end of the outer pipe (106) and sealed at the top to the outer pipe (106) with a slide seal (260) so that the sleeve-nozzle assembly (255–270) can oscillate with the outer pipe (106). The sleeve assembly, which is approximately half the thickness of the tar sand zone, can be raised and lowered with cables (245) connected to a winch (230) in the well head (211). The water pressure in annulus (250) will force the sleeve nozzle assembly (255–270) down when the cables (245) are released. The lower end of the sleeve assembly (255) is equipped with a sliding and rotating seal (265) around a pipe (275) providing a flush liquor annulus (280) around the stationary, center pipe (109), extending from a few feet inside the major annulus (250) to within 5 to 10 feet from the bottom of the well tool.

Injected water passes from the annulus (250) to the four high velocity, high volume nozzles (270) located on the bottom of the sleeve (255). These nozzles (270) can be pivoted a total of 135°, from aiming straight down to 45° upward, by hydraulically operated motors (271) actuated from the surface and equipped with position indicators. When the nozzles are aimed below the horizontal, they will flush accumulated sands toward the outlet thus controlling the amount of sand accumulated on the bottom of the cavity.

Four sonic transmitters and receivers (290), connected with electrical cables to the surface are located above the nozzles to permit monitoring of the cavity development.

A relatively small amount of the injected water passes through the flush liquor annulus (280) to multiple nozzles (285) located a few feet above the sump (105, FIG. 1). This water keeps the sump (105, FIG. 1) agitated and assists in flushing the sand-water-oil slurry into the outlet through slotted openings (295) in the otherwise closed center pipe (109). The openings are sized to prevent entry of stones and debris that can cause problems in the surface plant.

A level sensor (286) close to the bottom of the well tool controls the addition of make up water so that the sump does not run dry. All hydraulic and instrument lines are flexible to accomodate turning of the well tool.

The required pressure in the cavity is maintained equal to the weight of the overburden. The pressure in the recovery plant is equal to the cavity pressure minus the friction losses in the mining tool minus the hydraulic head of the slurry. The maximum temperature of the slurry to avoid heat losses due to evaporation of water in the surface plant is determined by the boiling point of water at the surface plant pressure. Typical cavity pressures and maximum cavity temperatures for different depths are shown in Table 1. This table, and the other tables, are placed for convenience at the end of the specification.

The temperature used depends upon the nature of the tar sand and the desired rate of mining. Generally, the tars are sufficiently fluid at 200° F. to flow readily. When the tar sand is heated to 200° F. or above the sands can be dislodged and flushed away by the hydraulic miner. The rate that this occurs depends on the rate of heat penetration into the tar sands. The heat is transferred from the water jets and vapor space over the surface of the cavity. The higher the cavity temperature and with a certain minimum jet rate, the higher will be the rate of heat penetration and tar sand removal. Typical mining rate versus temperature is shown in Table 2, for a 400 foot diameter cavity in a 100 foot thick seam containing 10% bitumen.

Mining proceeds in a radial direction starting at the tar sand zone floor. Heat is transferred from the hot cavern atmosphere to the water jet and to the tar sand face. This melts the tar, and makes the face weak so that when the water jet hits it, the sand and its contents are dislodged. The high velocity water from the jets (270) sluices the sand, water and oil, into a collection sump (105, FIG. 1). Water from the flush liquor annulus (280) keeps the collection sump agitated. The level controller assures a water seal by controlling the make up water. High pressure inert gas and steam are injected into the well to fill the mining voids, to maintain system pressure to support the roof and to maintain required temperatures. The temerature of the cavity is maintained at 200°–450° F. Use of this temperature and additives, such as polypyrophosphates, EDTA, etc., in the water assist in separating the oil from the sand.

The tar sand layer under the roof is impermeable to gas and therefore the cavity pressure acting on this layer supports the cavern roof and overburden. As the cavity grows, less and less of the dislodged sand is removed to the surface oil recovery plant. By the end of the mining operation, up to 50% of the sand may remain in the cavity.

The formation is mined from the bottom outward and upward. Turning and elevating of the nozzle sleeve and pivoting the nozzles up and down permits mining in all radial directions. FIG. 1 shows the cavity outline at various times ($T_1$ to $T_3$) during mining. At time $T_1$, the jet nozzles are on the floor aiming in a horizontal direction and undercut the cavity to about 100 feet. At time $T_2$, the nozzle system is elevated above the cavern floor by about one-quarter of the thickness of the tar zone to the tar sand zone. At this height, the high pressure nozzle can cut out to 150 feet radially aiming the nozzles upward. The nozzle system proceeds up to a height of about one-half the tar zone thickness and cuts radially to about 200 feet and upward toward the roof until the cavern is the shape designated at time $T_3$. This is the maximum distance at which the water jets can hydraulically dislodge sand and at this time (about 2 months after start) the system has produced at an average rate of about 10,000 narrels per day. Throughout the mining operation, the sonar sounding system monitors the cavity dimensions, and warns of excess roof penetration through the tar sand seam. At the end of the mining operation, the impermeable ceiling support membrane is at least 10 feet thick, a safe thickness needed to prevent gas breakthrough and collapse of the roof. When the maximum reach of the nozzles is attained, the cavern is refilled by pumping down a sand-water slurry through the well casing under pressure while removing water and residual oil that drains to the well sump.

After completion of filling the cavern, the well is closed in and put on standby for possible future secondary recovery of hydrocarbons. Table 3 lists typical operating parameters for a 1000 ft. deep well in a 100 ft. thick seam.

Referring now to FIG. 3, there is shown a flow sheet of the above ground operation for recovering the hydrocarbon values from the tar-sand-water slurry removed from the cavity. The slurry goes first to hydroclones (300) which separate the bulk of the sand as a heavy slurry in water from the bitumen and the rest of the water. The underflow-sand in water-goes to an agitated receiver (302), whence it is pumped by a pump (304) to a previous mined-out zone to eventually fill that cavity, or to an impounded area for eventual return to the cavity being mined. The overflow goes to an agitated tank (306), where it is mixed with light oil, which reduces the density of the oil phase thus permitting easy gravity separation of the oil-bitumen phase from the water. This light oil is preferrably a naphtha which can be readily separated from the tar oil by distillation. The naptha-oil-water mixture is then sent to a decanter (308) where the tar-naphtha solution is separated from the water and any sand carried over from the hydroclone (300). The bottoms underflow of sand and water from the decanter (308) are pumped by pump (310) back to the feed to the hydroclones (300). Clear hot water is drawn from the center of the tank, and is pumped by pump (312) back into the cavern, along with additional make-up water supplied by pump (313). The overflow passes into heated storage tanks (314), thence through pump (315) to a fired heater (316), and then into a flash stripper (318), where the naphtha is evaporated and separated from the tar product. The naphtha is condensed in a condenser (320) and goes to a storage tank (324) and back to agitated tank (306). There is a small amount of water present from the steam used in the stripper (318); this water is sent to the producing well from the bottom of tank (324) by pump (323). The tar at the bottom of the still is pumped by the stripper pump (330) to heated storage tank (332).

In operation of the above-ground system, all of the system which contains water is maintained under sufficient pressure so that the water is below its boiling point at the temperature employed, in order to avoid the high loss of energy due to the high heat of vaporization of water. This means that the hydroclones (300), the agitated sand slurry tank (302), the agitated tank (306) where the naphtha is added, the decanter tank (308) and all the piping associated with them must be under pressure. The necessary pressures are easy to maintain, since the slurry from the mining operation is under pressure, and can be readily carried over into the separation system. The only additional energy required to keep pressure is that required to overcome the friction losses in the system for recycle of water and sand slurry to the wells and for the supply of make-up water and naphtha to the system.

The details of the operation can obviously be changed without departing from the invention herein, which is set forth in the claims.

TABLE 1

SYSTEM PRESSURES AND MAXIMUM ALLOWABLE TEMPERATURE VS. DEPTH

| Overburden Depth Ft | Cavern Pressure psia* | Recovery System Pressure psia | Maximum Cavity Temperature, °F. |
|---|---|---|---|
| 500 | 500 | 220 | 389 |
| 1000 | 1000 | 440 | 454 |
| 1500 | 1500 | 660 | 497 |
| 2000 | 2000 | 880 | 529 |
| 3000 | 3000 | 1320 | 578 |

*Assuming an average density of 2.30 for the overburden.

TABLE 2

EFFECT OF CAVITY TEMPERATURE ON MINING RATE (10 wt. % Bitumin - 100 ft. Thick Seam - 200 ft. Reach)

| Cavity Temperature °F. | Penetration Rate, inched/hour | Average Mining, BPSD* |
|---|---|---|
| 200 | 0.5 | 1350 |
| 250 | 1.4 | 3790 |
| 300 | 2.7 | 7280 |
| 350 | 3.8 | 10240 |
| 400 | 4.8 | 12900 |
| 450 | 5.7 | 15400 |

*BPSD - Barrels per Stream Day

TABLE 3

TYPICAL SYSTEM OPERATING PARAMETERS

| | |
|---|---|
| Cavern Depth | 1000 ft |
| Deposit Thickness | 100 ft |
| Cavern Pressure | 1000 psia |
| Average Production Rate | 10,000 BPSD* |
| Design Production Rate | 15,000 BPSD* |
| Well Life | 60–70 Days |
| Oil Recovery from Well | 80% |
| Oil Concentration | 10 wt % of sands |
| Design Jet Nozzle Water Rate | 18,000 GPM |
| Design Slurry Water Pump Rate | 20,000 GPM |
| Pump Horsepower | 5,000 |
| Design Plant Heat Input with Cavity Temperature at 400° F. | 375 MM BTU/hr |

*Barrels per Stream Day

What is claimed is:

1. In a method of mining tar sands which are in beds too deep below the surface to be economically mined by stripping the overburden, and in which a well is sunk through the overburden and the tar sands layer into the underlying bedrock, the well is cemented to the overburden and a hot aqueous fluid is injected into the well and directed against the tar sands to heat the surface of the sands to render the tar therein sufficiently fluid so that it can be slurried into the aqueous fluid, and the slurry is forced up the well to a recovery system on the surface, while maintaining a sufficiently high pressure in the well with a non-condensable gas to support the overburden, the improvement which comprises:

(a) Maintaining at least a ten foot thick ceiling of tar sands in the cavity throughout the operations of mining and backfilling in order to provide an gas-impermeable seal and hence preventing the roof from falling in; and (b) Backfilling the cavity after primary hydraulic mining is completed, and before depressurization, with spend sand and aqueous fluid to both ensure against collapse of the cavity after depressurization and to dispose of the sand in an ecologically acceptable manner, whereby energy requirements and surface subsidence are minimized.

2. The method of claim 1, in which the mining rate is controlled by maintaining the temperature at the surface of the tar sands between 200° and 450° F.

3. The method of claim 1, in which the cavern formed by the mining operation is maintained at a pressure in pounds per square inch absolute at a number about the depth of the overburden in feet.

4. The method of claim 1, in which the aqueous slurry delivered to the recovery plant is first treated to remove most of the sand and much of the water to produce a treated slurry, said treated slurry is mixed with a distillable light hydrocarbon, said mixture is separated into an aqueous portion and a hydrocarbon portion; and said hydrocarbon portion is heated to distill off the light hydrocarbon leaving the product tar.

5. The method of claim 1, in which the improvement also comprises:

(c) Maintaining both the subsurface operations, and surface operations for separating oil from sand and water, at sufficiently high pressure so that the water is below its boiling point and the system does not cool off and lose heat by evaporation of water.

* * * * *